United States Patent [19]

Zaccaria

[11] 4,079,548

[45] Mar. 21, 1978

[54] DOUBLE BAFFLE LINEN CHUTE FIRE SAFETY DOOR

[76] Inventor: Nathan J. Zaccaria, 257 Glen Ave., Palisades Park, N.J. 07650

[21] Appl. No.: 759,738

[22] Filed: Jan. 17, 1977

[51] Int. Cl.[2] ..... E05B 65/04

[52] U.S. Cl. ..... 49/67; 232/44

[58] Field of Search ..... 49/67, 63, 62, 61; 232/44, 45

[56] References Cited

U.S. PATENT DOCUMENTS

| | | | |
|---|---|---|---|
| 280,294 | 6/1883 | Corliss | 49/67 X |
| 1,222,964 | 4/1917 | Matchette | 49/67 X |
| 1,224,766 | 5/1917 | Martin et al. | 49/67 |
| 1,824,881 | 9/1931 | Foss | 232/45 |
| 3,198,094 | 8/1965 | Dunkerley | 49/67 |
| 3,382,611 | 5/1968 | Zandelin | 49/67 |
| 3,872,623 | 3/1975 | Spaulding, Jr. | 49/62 X |

*Primary Examiner*—Philip C. Kannan
*Attorney, Agent, or Firm*—Richard L. Miller

[57] ABSTRACT

A door for a linen chute for a building such as a hotel or hospital, the door having a double baffle so to insure against fire going therethrough, the double baffle comprising two individually hinged door plates, one behind the other.

6 Claims, 6 Drawing Figures

DOUBLE BAFFLE LINEN CHUTE FIRE SAFETY DOOR

This invention relates generally to door assemblies for building chute entrances.

A principal object of the present invention is to provide a door which gives additional fire safety for the standard hospital linen chute as required by the revised N.F.P.A. life safety code.

Another object is to provide a chute door which can be quickly and easily installed without disruption of the chute normal service and which dos not require any building reconstruction of the present existing chute entrances.

Another object is to provide a chute door which is particularly designed for use on linen chutes of hospitals and may be used on linen chutes of hotels, and the like.

A further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 3:
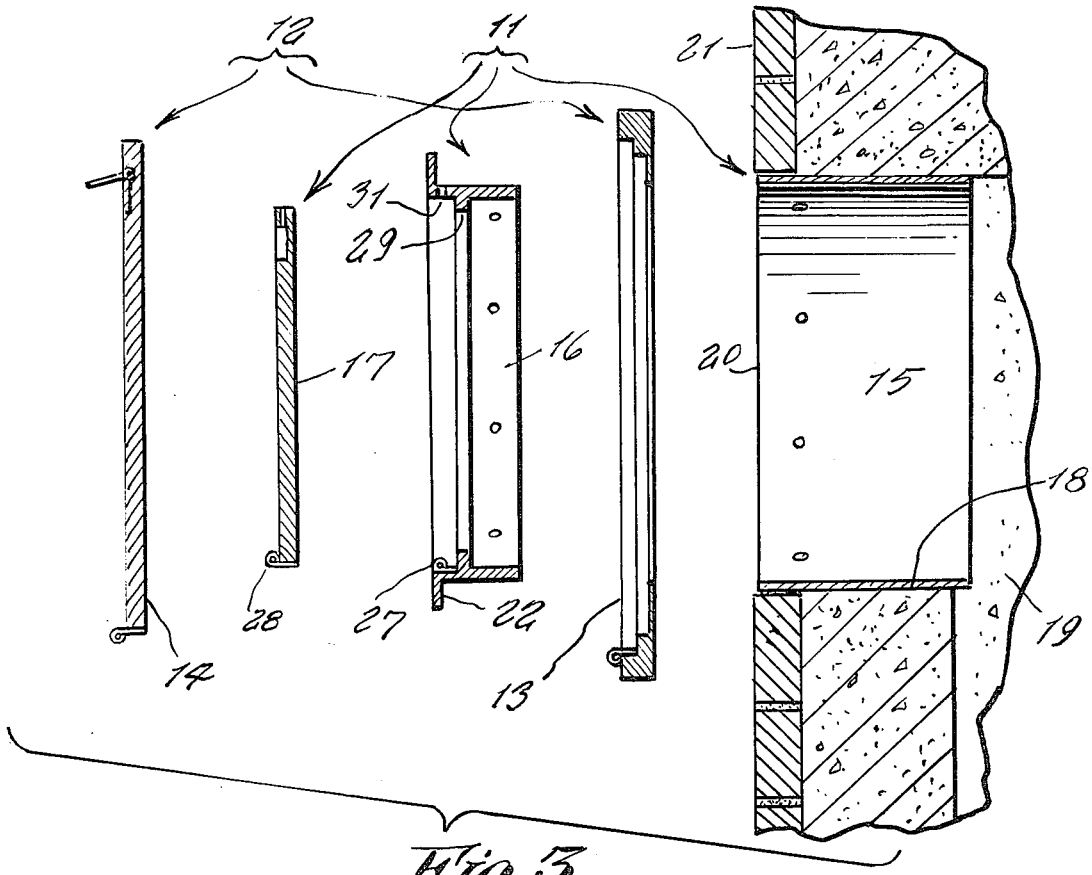
FIG. 3 is a side cross sectional exploded view of the invention components.
Figure 2:
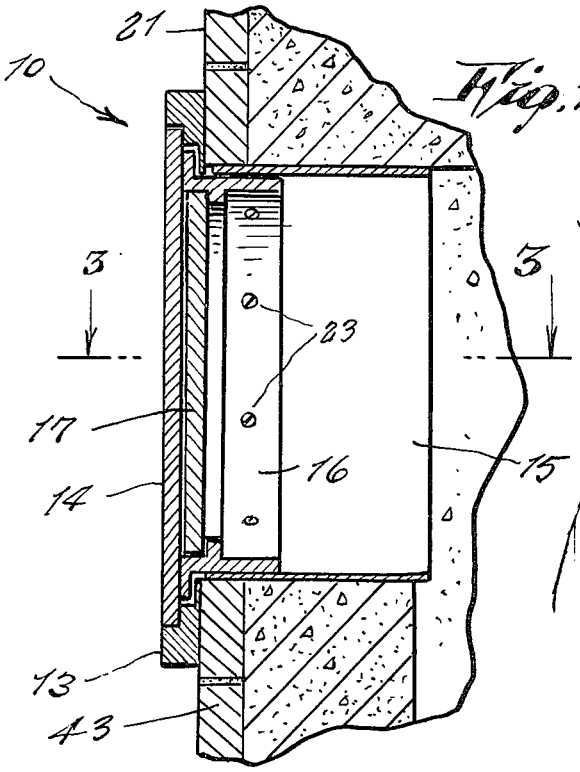
FIG. 2 is a cross section on line 2—2 of FIG. 1.
Figure 1:
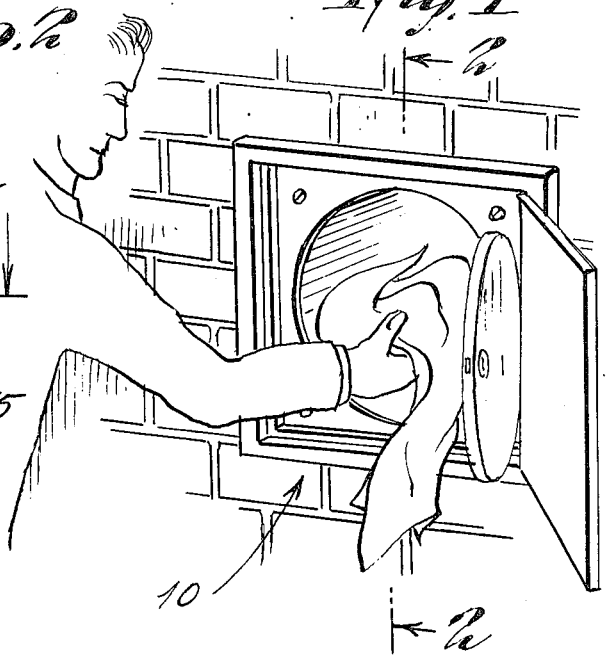
FIG. 1 is a perspective view of the invention shown in use.
Figure 4:
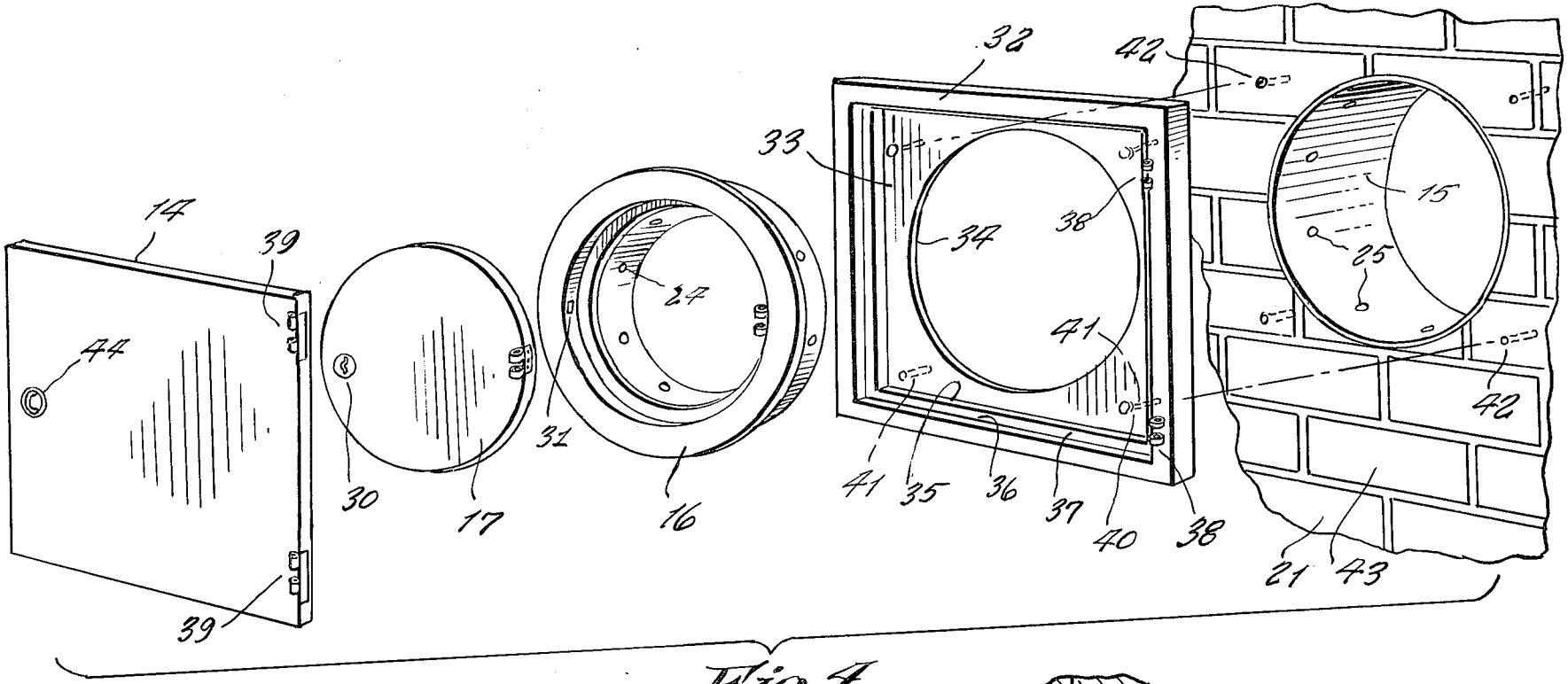
FIG. 4 is a perspective view thereof.
Figure 6:
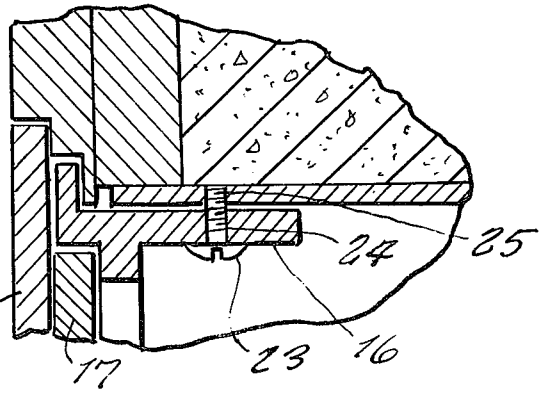
FIG. 6 is an enlarged detail showing the bolting structure.
Figure 5:
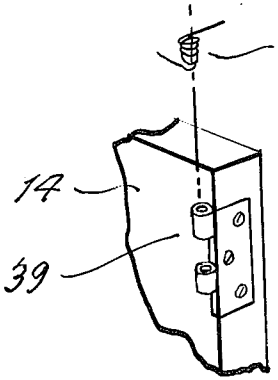
FIG. 5 is an enlarged detail of the front door shown in FIG. 4.

Referring now to the drawings in detail, the reference numeral 10 represents a double baffle linen chute fire safety door according to the present invention which is comprised of a present existing standard door assembly 11 and an additional door structure 12 which is added thereto, the new structure 12 consisting of a door supporting frame 13 and an outer door 14.

The present existing standard door assembly 11 includes a chute throat 15, a collar 16, and a circular door 17, that is hinged on the collar. The chute throat 15 comprises a cylindrical ring that is secured tightly in the entrance 18 of a linen chute 19, a forward edge 20 of the throat being slightly recessed from the finished wall surface 21 inside the building. The collar 16 comprises a cylindrical member of shorter length that slide fits inside the throat; a radially outward flange 22 of the collar abuting with wall surface 21. Screws 23 through clearance openings 24 in the collar and into threaded openings 25 of the throat, firmly secure the collar. The collar includes a hinge element 27 to which hinge elements 28 of the door 17 are attached by a hinge pin so to form a pivotable hinge. A radially inward flange 29 in the collar serves as a stop against which the door 17 abuts. The door includes a key operated lock 30 that engages a notch 31 in the collar.

The frame 13 is a square shaped frame element 32 integral with a thin wall 33 flush with one side thereof, the wall 33 having a circular central opening 34 therethrough of a size so to slidably receive the collar 16 thereinto. A square opening 35 in the frame element 32 has a groove 36 extending all around so to form a seat into which the outer door 14 is receivable in order that a front side of the door 14 is flush with a front side of the frame. The inner side of the door 14 thus abuts against a shoulder 37 of the groove. The frame has hinge elements 38 to which hinge elements 39 of the door 14 are attached by hinge pins so to form hinges about which the door pivots. The frame includes an opening 40 near each corner through the wall 33 so to receive mounting screws 41 receivable into four holes 42 drilled into the inner wall surface 21 of the building wall 43, and which comprises the only structural change made to the building itself for installing the present invention.

The door 14 is square in shape so to fit the square groove 36. A flush mounted door pull 44 is mounted in the door outer side. A tension coil spring 45 around each hinge pin normally keeps the door 14 biased into a closed position within the frame.

In converting a conventional linen shute door assembly 11 to the double baffle linen chute fire safety door 10 of the present invention, the collar is simply unbolted from the throat and removed. The frame 13 is then fitted on the collar and the collar is re-installed in the throat with the screws 23. The frame thus positioned against the wall surface 21 thus locates the position where holes 42 are drilled, for receiving mounting screws 41 in order to secure the frame to the wall 43. Door 14 is then mounted in the frame with the hinge pins and springs 45.

The new safety door is thus installed with inner and outer doors 17 and 14 respectively being adjacent each other.

While certain novel features of this invention have been shown and described and are pointed out in the annexed claims it will be understood that various omissions, substitutions and changes in the forms and details of the device illustrated and in its operation can be made by those skilled in the art without departing from the spirit of the invention.

What is claimed is:

1. A double baffle linen chute fire safety door comprising in combination, an existing door assembly and an additional door assembly attachable to said existing door assembly; said existing door assembly comprising a throat installed in an entrance of a building linen chute, an existing door frame comprising a collar screwed into said throat and an outward flange extending from said collar adapted to be positioned to abut a wall surface of the building, and a circular door hingedly supported on said collar; said additional door assembly comprising an additional door frame having a thin rear wall, an opening through said thin wall for receiving therethrough said collar, said outward flange abutting said thin wall, whereby said thin wall is sandwiched between said outward flange and the wall surface when said collar is screwed into said throat, mounting openings on said thin wall for receiving mounting screws to mount said additional frame onto the wall surface, and an additional door hingedly supported on said additional frame.

2. The combination as set forth in claim 1 and wherein said circular door is smaller than said additional door.

3. The combination as in claim 1 and wherein said throat is inwardly spaced from the building wall surface.

4. The combination as in claim 1 and wherein said circular door has a key operated lock and said additional door has a flush mounted door pull.

5. The combination as set forth in claim 1 and wherein said existing door frame further comprises a recessed seat for receiving said circular door, wherein said additional door frame comprises a recessed seat for receiving said additional door, and wherein said two doors are adjacently spaced from each other when both are in a closed position.

6. The combination as set forth in claim 5 and wherein said circular door is flush mounted with said outward flange and said additional door is flush mounted with said additional door frame.

* * * * *